United States Patent [19]

Shapiro

[11] 3,972,013

[45] July 27, 1976

[54] ADJUSTABLE SLIDING ELECTRICAL CONTACT FOR WAVEGUIDE POST AND COAXIAL LINE TERMINATION

[75] Inventor: Sanford S. Shapiro, Canoga Park, Calif.

[73] Assignee: Hughes Aircraft Company, Culver City, Calif.

[22] Filed: Apr. 17, 1975

[21] Appl. No.: 566,881

[52] U.S. Cl. ..... 333/97 R; 333/33; 333/98 R

[51] Int. Cl.[2] ..... H01P 1/28; H01P 3/06

[58] Field of Search ..... 333/31 R, 83 R, 82 B, 333/33, 97 R, 98 R, 34

[56] References Cited

UNITED STATES PATENTS

| | | | |
|---|---|---|---|
| 2,535,329 | 12/1950 | Steigerwalt | 333/35 X |
| 2,644,140 | 6/1953 | Pease | 333/31 X |
| 2,740,848 | 4/1956 | Starner et al. | 333/83 R X |
| 2,900,610 | 8/1959 | Allen et al. | 333/35 |
| 3,246,266 | 4/1966 | Racy | 333/83 |
| 3,392,354 | 7/1968 | Plutchok | 333/83 X |

*Primary Examiner*—Harold A. Dixon
*Assistant Examiner*—Marvin Nussbaum
*Attorney, Agent, or Firm*—Allen A. Dicke, Jr.; William H. MacAllister

[57] ABSTRACT

A waveguide post slides through a resilient barrel which is adjustably clamped against the waveguide post to control its slidability and provide reliable electric contact. As a sliding short for a coaxial transmisson line termination, a shorting bar incorporating two resilient barrels engages both the inner and outer conductors of the coaxial transmission line with resilient clamping and reliable electrical conduction.

13 Claims, 8 Drawing Figures

Fig. 1.
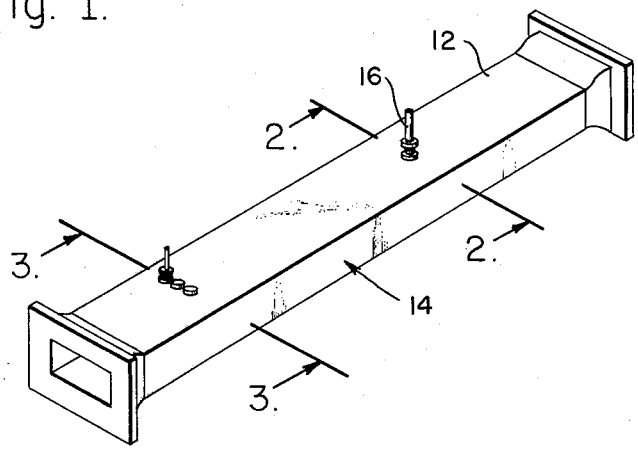
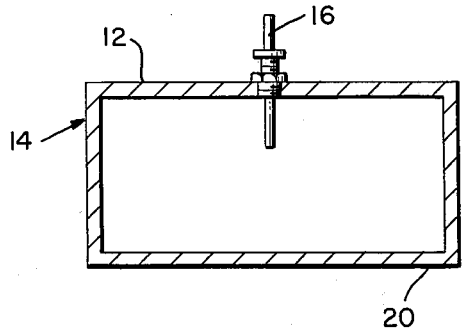
Fig. 2.
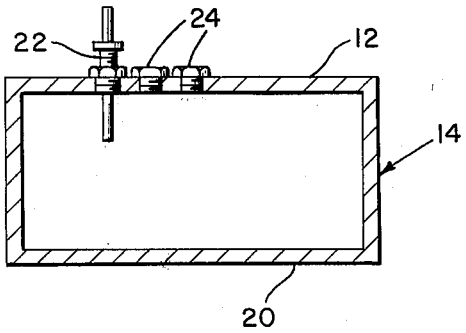
Fig. 3.

Fig. 4.
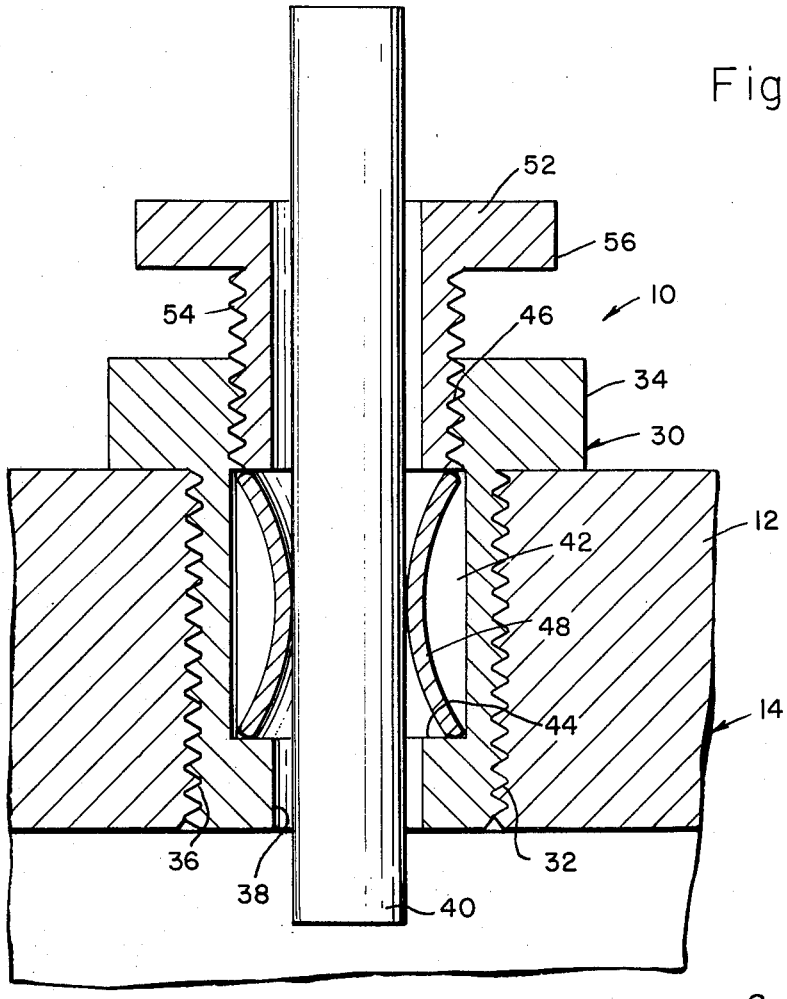
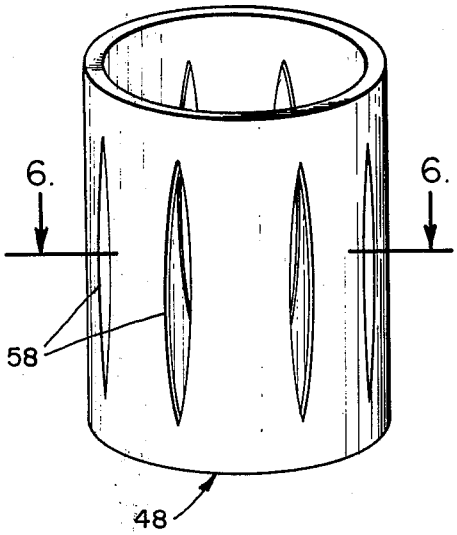
Fig. 5.
Fig. 6.
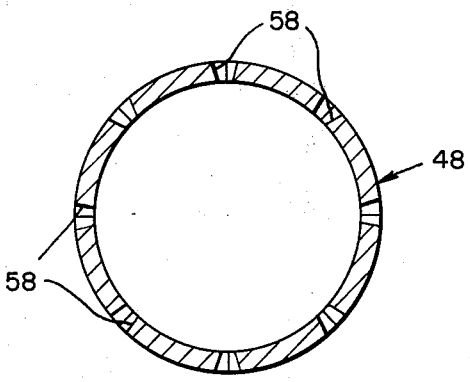

ADJUSTABLE SLIDING ELECTRICAL CONTACT FOR WAVEGUIDE POST AND COAXIAL LINE TERMINATION

FIELD OF THE INVENTION

This invention relates to a sliding contact for electromagnetic waveguide structures and particularly to the mounting thereof as adjustable sliding waveguide posts for controlling the waveguide impedance and for providing an adjustable sliding short as a coaxial transmission line termination.

Hollow conductively bounded waveguide structures have been used for many years in connection with the transmission and utilization of microwave energy. In addition to their most common application as a transmission medium for electromagnetic wave energy, waveguides are also utilized as the basic building block for many active and passive microwave devices. Obstacles such as screws, posts, windows, and irises have been utilized in waveguides for impedance matching, tuning, or filtering.

If it is desired to introduce a shunt capacitive susceptance in a waveguide operating in the dominant $TE_{10}$ mode, a post which extends partially into the interior of the guide from one broad wall parallel to the electric field vector can be utilized. By the same token, a post extending in the same direction completely across the waveguide between opposite broad walls will yield an shunt inductive susceptance. Of course, several posts and other obstacles can and usually are used in combination to produce the desired network.

Many techniques have been employed in the past to locate and hold reactive posts in waveguides. Since the placing of such posts requires both good electrical and mechanical contact with the waveguide walls, bonding techniques such as soldering, brazing, and welding have been widely utilized. It is often desirable however to employ waveguides fabricated of material such as aluminum which are not readily adapted to such bonding techniques. Of course, it is possible to apply a coating or film of solderable material to an aluminum waveguide to which the reactive post may be soldered. This process however introduces other manufacturing steps in the fabrication process, thereby increasing cost. Also it is often desirable to have the post penetration adjustable.

Schooley U.S. Pat. No. 2,668,276; Gilchrist U.S. Pat. No. 2,863,128; and Hudspeth U.S. Pat. No. 3,843,941 each show the utilization of a waveguide post for the control of waveguide impedance. Weber U.S. Pat. No. 2,853,687 and Cooper U.S. Pat. No. 3,449,698 each show particular constructions by which such waveguide posts can be placed in and adjusted in the waveguide cavity. Weber shows (in FIGS. 1 and 5) a complex structure of limited adjustability and (in FIG. 4) a structure of greater complexity and less reliable electrical grounding of the post. Cooper shows a simple, inexpensive, and well-grounded post which is fully adjustable but more difficult to adjust. The adjustable sliding waveguide post of this invention has the advantages of being inexpensive, easily adjustable, lockable in position, and of reliable electrical contact of the waveguide post to the waveguide body.

Similar problems arise in the termination of a coaxial line with an electrical short, so that the shorting bar between the inner and outer conductors can be positioned to provide the desired projected reactance or susceptance at some particular location along the coaxial transmission line in front of the short.

SUMMARY

In order to aid in the understanding of this invention, it can be stated in essentially summary form that it is directed to an adjustable sliding electrical contact wherein a resilient barrel extending around the waveguide post is grounded to the waveguide and adjustably embraces the post for security of adjustment of post penetration and for positive electrical contact.

It is thus an object of this invention to provide an adjustable sliding waveguide post which is electrically and mechanically reliable. It is a further object to provide such a waveguide post which is economic of construction and easy to use so that the desired shunt susceptance can be readily achieved by adjustment and maintained through accurate positioning of the post and secure electrical grounding thereof. It is another object to provide an adjustable sliding waveguide post where electrical contact between the waveguide body and the waveguide post is maintained by a resilient contact of the barrel with the post which also acts to clamp the post in place.

It is a further object to provide a sliding shorting bar which is capable of being connected to the end of the coaxial transmission line so that the projected impedance of the coaxial transmission line in front of the short can be regulated by sliding the short between the inner and outer conductors along the axis of the coaxial transmission line.

It is a further object to provide a sliding short for a coaxial transmission line which includes resilient metallic engagement with both the inner and outer conductors of the coaxial transmission line.

Other objects and advantages of this invention will become apparent from the study of the following portion of the specification, the claims, and the attached drawings.

BRIEF DESCRIPTION OF THE DRAWINGS

FIG. 1 is a isometric view of a waveguide having the adjustable sliding waveguide post structure of this invention in two locations thereon.

FIG. 2 is an enlarged section through the waveguide taken generally along the line 2—2 of FIG. 1.

FIG. 3 is a section similar to FIG. 2, taken generally along the line 3—3 of FIG. 1.

FIG. 4 is an axial section through the adjustable sliding waveguide post construction showing the details thereof.

FIG. 5 is an enlarged perspective view of the resilient barrel employed in the waveguide post structure.

FIG. 6 is a section taken generally along the line 6—6 of FIG. 5.

DESCRIPTION OF THE PREFERRED EMBODIMENT

Figure 7:
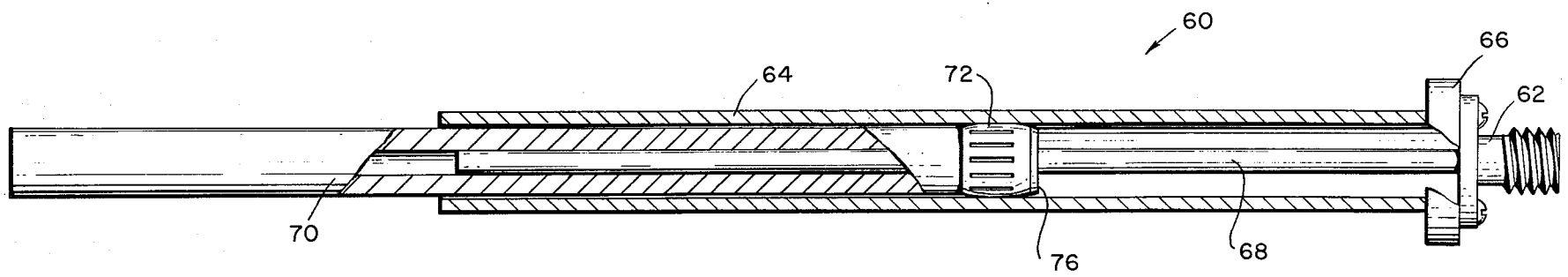
FIG. 7 is a side elevational view with parts broken away and parts taken in section of the adjustable sliding short of this invention configured for a coaxial transmission line termination.

The adjustable sliding waveguide post construction of this invention is generally indicated at 10 in FIG. 4. The post structure can be used in the broadwall 12 of waveguide 14. The broadwall is the outer body. One of the post structures identical to the waveguide post structure 10 is shown at 16 in FIGS. 1 and 2. The post structure 16 is in the center of the broadwall. The length of the post of this structure can be adjusted into the waveguide to provide the desired shunt capacitive susceptance. The post can be adjusted in and out and can touch the opposite broadwall 20 if desired, to provide shunt inductive susceptance. A specific value of shunt inductive susceptance can be realized by controlling the post diameter and the distance the post is offset from the center of the broadwall.

FIG. 3 shows another section through waveguide 14 where post structure 22 can be positioned in any one of the laterally positioned holes across the width of the broadwall. The post structure 22 is in one of the holes, and the other two holes are plugged by plugs 24. The plugs 24 can be removed and replaced by other post structures for impedance selection. Lateral positioning across the broadwall, as shown in FIG. 3, enables different values of shunt inductive susceptance to be realized for a post extending between the 2 broad walls 12 and 20.

The post structure 10 provides a device whereby the reactive post can be moved in and out of the waveguide until the desired shunt susceptance is achieved and thereupon held in position and in reliable electrical contact by firm mechanical clamping.

FIG. 4 illustrates the adjustable sliding waveguide post structure in more detail. Bushing 30 has a threaded exterior 32 beyond which top flange 34 extends. Top flange 34 acts as a stop when bushing 30 is screwed into threaded hole 36 in broadwall 12 of waveguide 14. Additionally, the exterior of top flange 34 can be shaped, for example hexagonally, to permit wrenching of the bushing in place into the waveguide wall.

Interiorly, bushing 30 has an opening 38 therethrough for the passage of post 40. The depth of penetration of post 40 into the waveguide is adjustable. Cavity 42 extends downward to the facing wall of inwardly directed flange 44 through which opening 38 extends. The upper part of the cavity has interior threads 46.

Clamp screw 52 has exterior threads 54 which engage in threads 46 so that clamp screw 52 can be screwed down into bushing 30, including into the top part of cavity 42. Flange 56 can be cut in hexagonal shape or knurled for tightening.

Barrel 48 is a cylindrical tube having a plurality of slots 58 therein. Slots 58 are cut completely through the tube from outside to inside, but do not extend from end-to-end thereof. Furthermore, the slots are cut with a double conical cutter so more material is removed from adjacent the outer surface of the tube of the barrel than from the inner surface. This reduces the strength adjacent the outer surface as compared to the strength adjacent the inner surface.

Barrel 48 is positioned in cavity 42 with post 40 extending therethrough. Clamp screw 52 is tightened down on the barrel to put longitudinal compressive stress on the barrel. As the barrel strains due to the stress, due to some prebending and also to the shape and positioning of slots 58, the center part of the barrel intermediate the ends resiliently bends inwardly to clamp on post 40, so that it serves as a clamp member. The amount of clamping force is dependent upon the stress applied by clamp screw 52. By adjustment of clamp screw 52 the amount of clamping force of the barrel 48 onto post 40 can be controlled. For adjustment purposes, the barrel should be clamped on the post sufficiently firmly that the post can be slid through for adjustment of its length, but is firmly engaged.

Post 40, barrel 48, bushing 30, and waveguide 14 are all metallic so that there is electrical contact from the post to the waveguide. The electrical contact is reliable, because of the firmness of the clamping engagement of barrel 48 on post 40. When each post is adjusted to the desired impedance, if desired, clamp screw 52 can be tightened down to increase contact pressure and help hold it in place during vibration. On the other hand, when so adjusted, the entire post structure 10 can be removed for measurement of its depth of penetration, so that it can be replaced with a rod of corresponding fixed length secured to a plug which closes the hole in the broadwall of the waveguide. As required for different impedances, one or more of the plugs 24 can be replaced with the post structure 10.

FIG. 7 shows a sliding short structure 60 for termination of a coaxial transmission line. Standard coaxial connector 62 is for connection to a standard coaxial line, to the right end of the drawing. Body 64 serves as the outer body of sliding short structure 60 and corresponds to the outer tubular conductor of the coaxial transmission line. Outer body 64 has a flange 66 by which it is connected to the coaxial connector 62. Within outer body 64 is inner conductor 68 which can be electrically connected through connector 62 to the inner conductor of an attached coaxial line.

Figure 8:
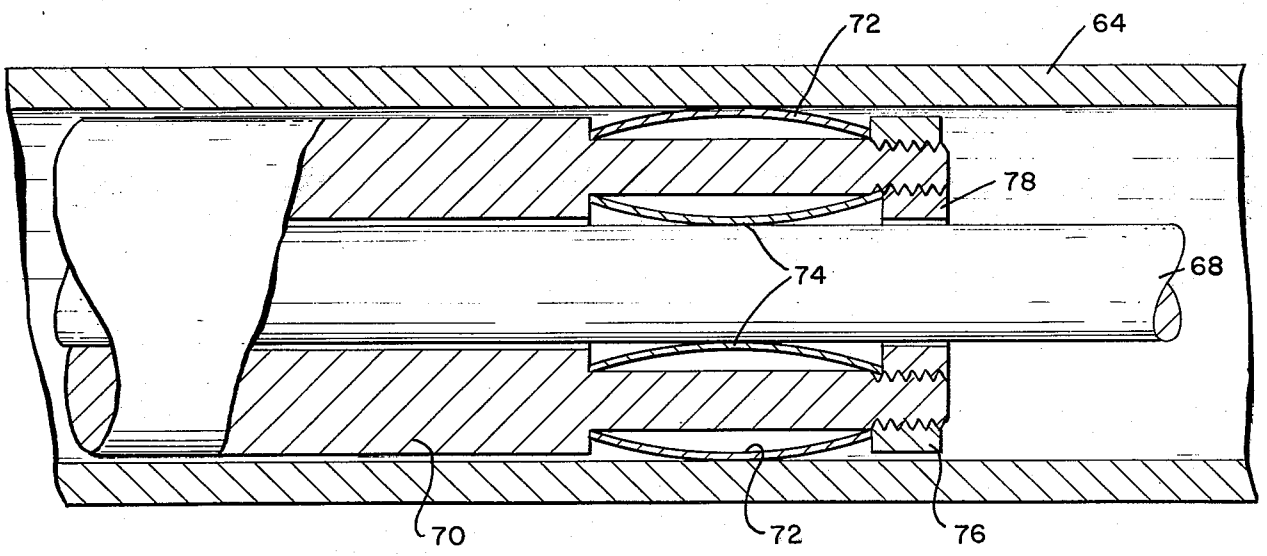
FIG. 8 is an enlarged detail of a portion of the cross section of the structure of FIG. 7.

Sliding shorting bar 70 is a tube which embraces inner conductor 68 and slides within outer conductor body 64 so that its position along the length of the outer conductor body and inner conductor can be controlled. Engagement between sliding shorting bar 70 and the inner and outer conductors is assured by means of barrel springs 72 and 74. This structure is shown in more detail in FIG. 8. Barrel spring 72 is positioned in a recess which is inwardly directed from the outer wall of sliding short tube 70 while barrel spring 74 is in a recess extending outwardly from the inner bore of tube 70. Each of the barrel springs 72 and 74 is like the barrel spring 48, each being tubular, metallic, partially longitudinally slitted and resilient. Ring nuts 76 and 78 are engaged upon appropriate threads and rotate around the central axis of the device, the axis of inner conductor 68. As these nuts are tightened, they tighten down upon barrel springs 72 and 74 to cause them to bulge. The inner barrel spring 74 bulges inward while the outer barrel spring 72 bulges outward to respectively electrically and mechanically engage inner conductor 68 and outer conductor body 64. Thus an electrical short is achieved. The barrel springs are in resilient engagement and thus sliding short tube 70 can be longitudinally moved to change the axial position of the short and thus change the projected impedance at some particular location along the coaxial transmission line in front of the short. In this way, a structure of similar nature is used in adjusting the impedance in a coaxial transmission line or in a waveguide.

This invention having been described in its preferred embodiment, is clear that it is susceptible to numerous modifications and embodiments within the ability of those skilled in the art and without the exercise of the inventive faculty. Accordingly, the scope of this invention is defined by the scope of the following claims.

What is claimed is:

1. An adjustable sliding electrical contact structure comprising:

a bushing for securement into the outer body wall of a waveguide, an interior space within said bushing terminated at one end by an axially facing wall and at the other end by a clamp movable with respect to said bushing, through said bushing, a conductor post positioned through said bushing opening;

a clamp member positioned in said interior space between said facing wall and said clamp and embracing said post, said clamp member being structured so that, when said clamp is urged toward said facing wall to stress said clamp member, said clamp member is forced into resilient engagement with said post.

2. The structure of claim 1 wherein said clamp member is in the form of a hollow cylindrical tube having an axis and having ends, one end of said tube being in contact with said facing wall and the other end of said tube being in contact with said clamp.

3. The structure of claim 2 wherein said tubular clamp member has generally axially directed slots therein, said slots terminating short of one of said clamp member ends.

4. The structure of claim 3 wherein said slots in said tubular clamp member terminate short of both of its ends.

5. The structure of claim 4 wherein said slots extend through from the outer surface of said tubular member to the inner surface of said tubular member and are circumferentially wider on the exterior surface of said tubular member than on the interior surface thereof.

6. The structure of claim 3 wherein said slots extend through from the outer surface of said tubular member to the inner surface of said tubular member and are circumferentially wider on the exterior surface of said tubular member than on the interior surface thereof.

7. The structure of claim 3 wherein said clamp member is a clamp screw screwed into said bushing, said clamp screw having means thereon for engagement to rotate said screw with respect to said bushing to vary the clamping force on said clamp member.

8. The structure of claim 7 wherein said clamp screw engages directly on one end of said clamp member to directly exert clamping force onto said clamp member for resilient distortion thereof.

9. The structure of claim 8 wherein there is an opening through said clamp screw and said rod extends through said opening.

10. An adjustable sliding electrical contact structure comprising:

an outer conductor body of a coaxial transmission line;

a conductive bar slidably positionable with respect to said outer conductor body to serve as an electrical contact with said outer conductor body, said sliding conductive bar having a shoulder thereon and having a spring adjuster thereon;

a tubular axially stressed spring resiliently engaged between said outer conductor body, with one end of said tubular spring resting against said shoulder, said spring adjuster engaging on the other end of said spring to resiliently deflect said spring to provide mechanical engagement and electrical contact between said body and said bar.

11. The structure of claim 10 wherein said tubular spring is longitudinally slotted.

12. The structure of claim 11 wherein said outer conductor body is the outer conductor of a coaxial transmission line having an inner conductor therein, and said sliding conductive bar is a sliding electrical contact tube embracing around said inner conductor and within said body.

13. The structure of claim 12 wherein there is an interior resilient spring and an exterior resilient spring on said sliding conductive bar with said inner resilient spring engaging on said inner conductor and said outer resilient spring engaging on said outer conductor body, each of said springs being adjustable.

* * * * *